US005134771A

United States Patent [19]

Lee et al.

[11] Patent Number: 5,134,771

[45] Date of Patent: Aug. 4, 1992

[54] METHOD FOR MANUFACTURING AND AMORPHOUS METAL CORE FOR A TRANSFORMER THAT INCLUDES STEPS FOR REDUCING CORE LOSS

[75] Inventors: Albert C. Lee, Hickory; W. C. Harris, Maiden, both of N.C.

[73] Assignee: General Electric Company, King of Prussia, Pa.

[21] Appl. No.: 726,239

[22] Filed: Jul. 5, 1991

[51] Int. Cl.[5] ..... H01F 41/02

[52] U.S. Cl. ..... 29/609; 29/606; 336/213; 336/217; 336/234

[58] Field of Search ..... 29/609, 605, 606; 336/213, 217, 234

[56] References Cited

U.S. PATENT DOCUMENTS

| | | | |
|---|---|---|---|
| 4,615,106 | 10/1986 | Grimes et al. | 29/609 X |
| 4,724,592 | 2/1988 | Hunt et al. | 29/605 |
| 4,734,975 | 4/1988 | Ballard et al. | 29/609 X |
| 4,847,987 | 7/1989 | Ballard | 29/609 X |

*Primary Examiner*—Carl E. Hall

*Attorney, Agent, or Firm*—Henry J. Policinski; William Freedman

[57] ABSTRACT

In this method of manufacturing an amorphous metal transformer core, there is provided a core form that comprises sections of amorphous metal strip wrapped about the core window, the strip sections having edges at laterally opposite sides thereof and the core form having at its laterally opposed sides a pair of faces where the edges of the strip sections are located. This core form is subjected to an annealing operation to relieve stresses therein. Then, the strip sections are displaced with respect to each other in a first lateral direction to develop a telescoping relationship between juxtaposed strip sections that disrupts short circuiting adhesions between juxtaposed strip sections that had developed during the annealing step. Thereafter, the strip sections are returned in a lateral direction opposite to the first lateral direction to restore their edges to substantially their normal, or original, positions.

Disrupting the short circuiting adhesions results in reduced core loss in the final product, i.e., an amorphous metal transformer core.

26 Claims, 5 Drawing Sheets

METHOD FOR MANUFACTURING AND AMORPHOUS METAL CORE FOR A TRANSFORMER THAT INCLUDES STEPS FOR REDUCING CORE LOSS

FIELD OF INVENTION

This invention relates to a method for manufacturing a transformer core that comprises amorphous metal strip material wrapped about the window of the core and, more particularly, relates to a method of this type that includes steps for reducing the core loss developed within the transformer when energized.

BACKGROUND

In the general type of core-manufacturing method that we are concerned with, magnetic strip material is wrapped in superposed relationship about the window of the core to build up a core form, and the core form is later annealed at elevated temperature to relieve stresses therein. A problem that arises in such manufacture is that the heat of the annealing operation often produces, within the core, regions where juxtaposed sections of strip adhere together and form relatively low resistance paths, or shorts, between the adhering strip sections. Such internal adhesions or shorts are undesirable because they can produce within the core, transversely of the flux path therethrough, low-resistance closed circuits for eddy currents; and such closed circuits have the detrimental effect of reducing the effective net cross-section of the core, the amount of such reduction being a direct function of the cross-sectional core area bounded by such closed circuit or circuits.

In the manufacture of cores from traditional silicon-iron strip material, one approach that has been used for reducing the number of such internal shorts is to sharply strike the outer periphery of the annealed silicon-iron core form with a mallet or the like, thereby creating impacts which disrupt the adhesions forming the shorts. This approach has limited utility in the manufacture of amorphous metal cores because the amorphous steel strip material from which the core is formed is very brittle, especially after annealing, and is highly susceptible at this time to being cracked or shattered by any vigorous impacts delivered to the core. Another complicating factor with respect to cores of amorphous steel strip is that the strip material used in such cores typically has no insulating coating applied to it, and this increases the chances for developing metal-to-metal adhesions between juxtaposed sections of strip during annealing, as compared to the situation present with traditional silicon-iron strip, which typically has an insulating coating applied to it.

Another factor which tends to increase the chances for developing metal-to-metal adhesions between the juxtaposed strip sections of amorphous metal cores is that the amorphous strip material typically has surface irregularities on one side, much more pronounced than are present in traditional silicon-iron strip material, where both surfaces are relatively smooth. These surface irregularities result in the presence of small protrusions having peaks that tend to adhere to the juxtaposed strip material, especially when subjected to heat and pressure during annealing.

OBJECTS

A first object of our invention is to provide a simple procedure for breaking up such internal shorts that is applicable to annealed cores of amorphous metal strip material and that does not subject the core to impacts that crack or shatter the amorphous metal strip material.

Another problem that our invention is concerned with is the possibility that external adhesions will develop on the external lateral faces of the core form during the annealing operation and/or preceding operations. Such external adhesions can result from a projecting edge of one or more strips being bent over and contacting one or more edges of adjacent strips. These external adhesions can reduce the effective net cross-section of the core in ways similar to those explained above in connection with internal adhesions. Another object our invention is to provide a manufacturing method that substantially eliminates such external adhesions in the final core.

In U.S. Pat. No. 4,734,975-Ballard et al, which is incorporated by reference in the present application, there is disclosed, for making a transformer core from amorphous metal strips wrapped about the core window, a method that involves bonding together the edges of the metal strips with adhesive insulating coatings applied to the lateral faces of the core form. The material used for such coatings is applied in a viscous liquid state and is then heat-cured to cause the coatings to dry and harden. We are concerned with a method of this type, and another object of our invention is to accomplish the above-described first two objects of our invention without interference from the adhesive insulating coating material applied to the strip edges at the lateral faces of the core form.

SUMMARY

In carrying out our invention in one form, we provide the following method of manufacturing a core for an amorphous metal transformer. First, we provide a core form that includes a window and comprises sections of amorphous metal strip wrapped about the window, the strip sections having edges at laterally opposite sides thereof and the core form having at its laterally-opposed sides a pair of faces where the edges of the strip sections are located. Then the core form is annealed to relieve stresses therein. After such annealing, we displace the strip sections laterally with respect to juxtaposed ones of said strip sections to develop a telescoping relationship between juxtaposed strip sections that disrupts short-circuiting adhesions between the juxtaposed strip sections. Thereafter, we return the strip sections laterally to positions that restore their edges to substantially their normal, or original, positions that they occupied just prior to the telescoping operation.

In a specific form of the invention, we control the aforesaid lateral displacement of said strip sections by providing a pair of wedge members adjacent one face of the core form. Each wedge member has an inclined surface that is positioned to limit lateral motion of the strip sections with respect to each other. The inclined surface is so located that there is a gap of varying length between said inclined surface and said one face immediately prior to said displacement step.

BRIEF DESCRIPTION OF FIGURES

For a better understanding of the invention, reference may be had to the following detailed description taken in connection with the accompanying drawings, wherein.

DETAILED DESCRIPTION OF EMBODIMENT

Figure 1:
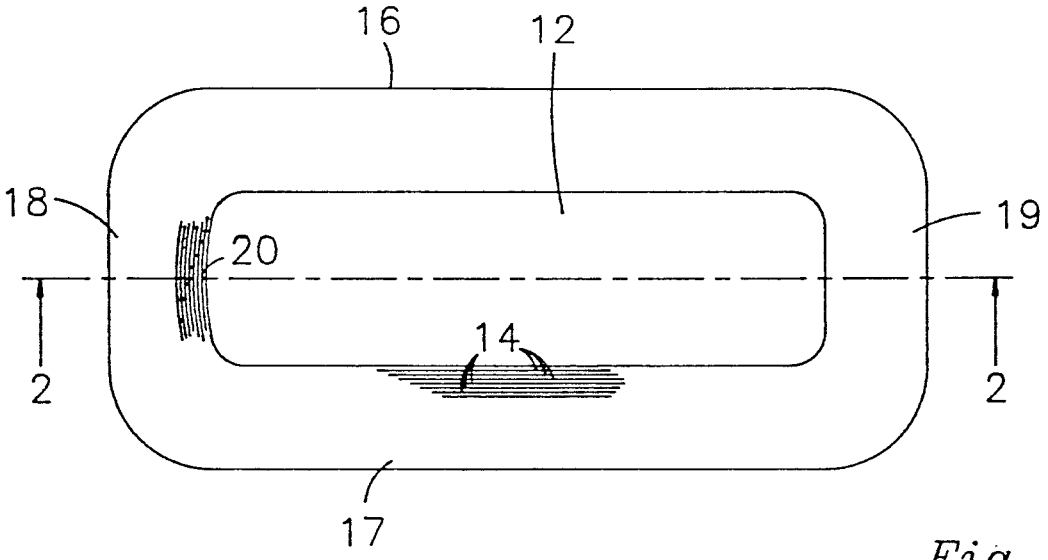
FIG. 1 is a plan view of a core form taken at an early stage in a manufacturing method involving our invention.
Figure 2:
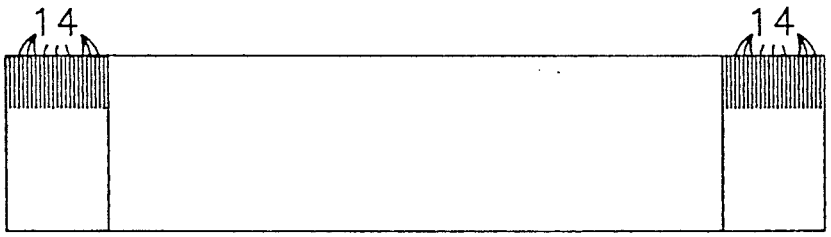
FIG. 2 is a sectional view taken along the line 2—2 of FIG. 1.

Referring now to FIGS. 1 and 2, there is shown a transformer core form 10 that comprises a window 12 about which have been wrapped strips, or strip sections, 14 of amorphous steel strip material. The core form comprises two spaced-apart legs 16 and 17 and two yokes 18 and 19 at opposite ends of the legs interconnecting the legs. In the illustrated core form, each strip 14 makes a full turn around the window 12, the ends being located in a joint region 20 in one yoke 18. Methods that can be used for building such core forms from amorphous steel strips are disclosed in Application Ser. Nos. 463,697-Ballard et al, filed Jan. 11, 1990, issued as U.S. Pat. No. 5,093,981 and Ser. No. 623,265-Klappert et al, filed Dec. 6, 1990, both assigned to the assignee of the present invention and incorporated by reference herein.

In practicing our invention in one form, we have used for the strip material an amorphous iron alloy purchased from Allied Signal Corporation, Parsippany, N.J. as its Metglas Transformer Core Alloy (TCA).

Typically, the core form is produced by winding or wrapping the strips in groups of superposed strips, or in packets containing superposed groups of strips, about a suitably shaped mandrel. Then the core form is removed from the mandrel, following which suitable tools are inserted into its window and then forced apart to produce the desired configuration of the window and surrounding core form. Many stresses are created in the amorphous metal by the forming and other fabricating operations, and it is necessary to relieve such stresses by an annealing operation. This annealing operation involves heating the core form to a relatively high temperature in an annealing oven, holding the core form at such a temperature for a predetermined time, and then allowing the core form to slowly cool. The annealing oven contains a non-oxidizing atmosphere, such as nitrogen, which envelops the core form while the core form is at elevated temperature.

As pointed out in the introductory portion of this specification, one problem that has arisen when the core form is subjected to annealing heat is that adhesions sometimes develop between juxtaposed strips, and these adhesions can form low-resistance closed-circuit paths for eddy currents that tend to reduce the effective cross-section of the core and thus to undesirably increase core loss when the transformer is later energized.

Figure 3:
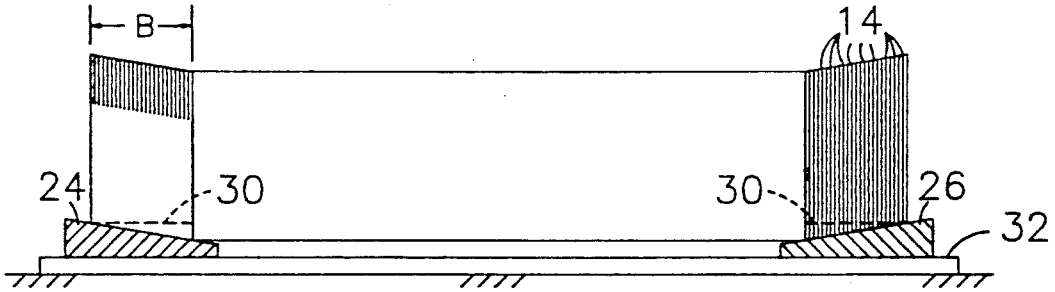
FIG. 3 is a sectional view of the core form of FIGS. 1 and 2 showing one step in a core manufacturing method embodying one form of our invention.

We have overcome this problem by employing a procedure which effectively disrupts these adhesions and thereby substantially eliminates the low resistance paths, or shorts, between juxtaposed strips. One form of this procedure is illustrated in FIG. 3, where the annealed core form is shown in a horizontal position resting upon two identical wedges 24 and 26 located beneath its yokes 18 and 19. Placing the core form in a horizontal position on the wedges causes the individual strips 14 to be laterally displaced with respect to their juxtaposed strips, thereby developing a telescoping relationship between the strips that disrupts any of the above-described short-circuiting adhesions between juxtaposed strips. The normal position of the lower edges of the strips immediately before such lateral displacement, or telescoping, is indicated by the dotted line 30 of FIG. 3. It can be seen that between this dotted line 30 and the inclined upper surface of each wedge there is a V-shaped gap having a length that varies across the width, or build, B of the core form, increasing proceeding from one periphery to the other of the core form.

This lateral displacement of the individual strips 14 can usually be produced simply by relying upon gravity to laterally displace the strips until their lower edges are blocked from further downward movement by the inclined upper surfaces of the wedges positioned therebeneath. Although the strips 14 had been wound or wrapped relatively tightly about the mandrel when the core form was being assembled, there is nevertheless sufficient looseness when the core form, after being annealed, is positioned on its side as shown in FIG. 3 to allow the strips to fall downwardly under the influence of gravity. In rare cases, insufficient looseness will be present to allow all the strips to fall onto the wedges solely under the influence of gravity, and in such cases, gentle taps to the top of the core form with a rubber mallet will cause all the strips to fall onto the wedges.

After the core form has been telescoped as shown in FIG. 3, it is returned to its normal state in which the edges of the strips 14 at each lateral face of the core form are substantially aligned. This is accomplished by removing the wedges 24 and 26 and allowing the lower face of the core form to rest on the planar face of a supporting plate 32 that is positioned in FIG. 3 beneath the core form. When the lower face of the core form abuts the planar face of plate 32, the strips are laterally restored to their normal positions with respect to each other, thus restoring the core form to its normal, non-telescoping state. Our studies of cores treated in this manner indicate that the adhesions disrupted by the telescoping action remain disrupted when the core is restored to its normal, or non-telescoping, state.

Although we have illustrated a method in which only two wedges are employed for controlling lateral displacement of the strips during the telescoping operation, our invention in its broader aspects comprehends the use of a single wedge or more than two wedges for this purpose. For example, in a core with relatively long legs, wedges can be positioned beneath the legs of the core in addition to beneath the yokes, as shown in FIG. 3.

In some exceptional cases a single telescoping operation may not be sufficient to disrupt all the internal adhesions in a core. If testing indicates that there are significant remaining internal adhesions after one set of telescoping and restoring operations has been completed, then one or more additional sets of telescoping and restoring operations may be carried out in the same manner as the first set until essentially all the internal adhesions are disrupted.

Figure 4:
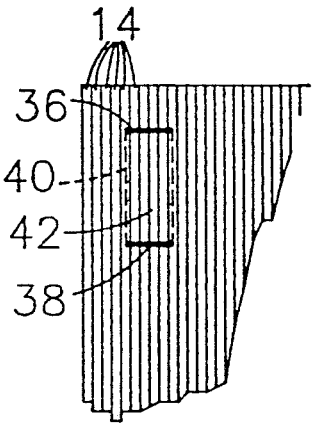
FIG. 4 is an enlarged schematic sectional view of a core form containing internal adhesions which our method is used to eliminate.

The manner in which the above-described adhesions adversely affect the performance of the core can be better understood by referring to FIG. 4. Two regions containing such adhesions are shown at 36 and 38. These adhesions form low resistance paths (or shorts) between the strips in each of the regions 36 and 38. As a result, there is a low-resistance, closed-circuit path 40 encompassing a region 42 of the core. When alternating magnetic flux is developed within the core during transformer operation, eddy currents are induced in the core which have a tendency to circulate in paths extending transversely of the direction of the flux. Normally, these eddy currents are limited to very low levels by the relatively high resistance that is present between juxtaposed strips 14 as a result of the natural oxides (which are electrical insulators) on the surfaces of the strips. But the adhesions at 36 and 38 represent short circuits through these oxide layers, and thus in these regions there is relatively low resistance between the strips. Accordingly, the above-described eddy currents can circulate with relatively little resistance around the close-circuit path 40. The result is that the effective net cross-section of the core in the cross-sectional zone depicted in FIG. 4 is reduced by approximately the cross-sectional area of region 42.

A result of such a reduction in effective net cross-section is a higher than nominal operating flux density for the core during transformer operation, which, in turn, means higher core loss. In addition, the reduction of the net effective cross-section may give rise to saturating the core at operating flux density and to excessively high exciting currents.

While FIG. 4 shows the internal adhesions in locations spaced from the lateral faces of the core form, the illustrated locations are merely exemplary. For example, one or more of the internal adhesions could be located immediately adjacent a lateral face of the core form.

Figure 5:
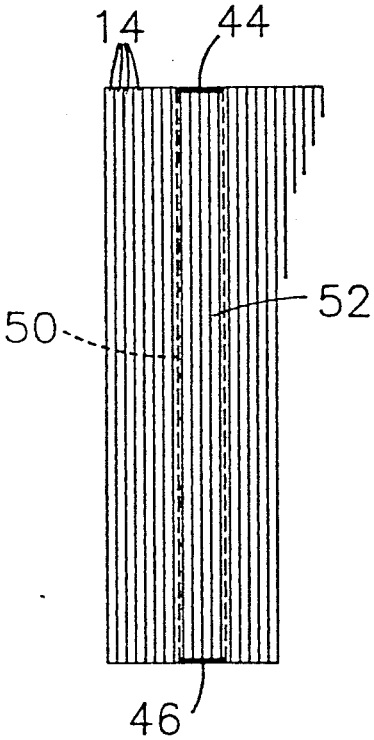
FIG. 5 is an enlarged schematic sectional view of a core form containing two external adhesions located at the lateral faces of the core form.

Another factor that can contribute to a reduction in effective net cross-section is a possible external shorting between adjacent strips 14 at the edges of the strips. Such external shorting can result from poor alignment of the strip edges at either of the two faces of the core. If such misalignment is present, the projecting edges can become folded over during fabrication of the core and can establish metal-to-metal contact with the edges of adjacent strips. Such contact would result in a low resistance path between the involved strips at the lateral faces of the core form. In FIG. 5 two such low resistance paths are illustrated at 44 and 46. The presence of these paths 44 and 46 results in a low resistance closed-circuit 50 extending over the full width of the core, thus producing the higher core loss and other undesirable effects referred to hereinabove.

Figure 6:
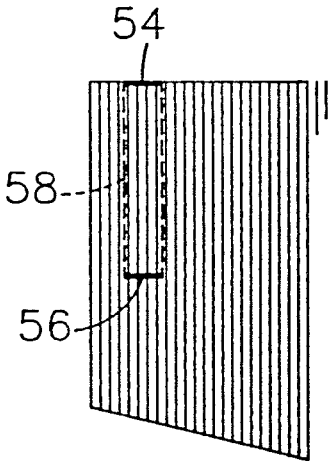
FIG. 6 is an enlarged schematic sectional view of a core form containing one external and one internal adhesion in the core form.

FIG. 6 shows how a combination of an external short (54) and an internal short (56) can result in the presence of a closed-circuit path (58) that reduces the effective net cross-section of the core, which, in turn, produces the higher core loss and other undesirable effects referred to hereinabove.

We greatly reduce the possibility of external shorts, such as 44, 46 and 54, by abrading the lateral faces of the core form after annealing with a wire brush or similar abrading tool. Wire brushing these faces removes any projecting and folded edges of the strips. The amorphous steel strips are quite brittle after annealing, and their projecting edges, which are also quite brittle, can be readily removed by a simple wire-brushing operation.

The presence of folded-over edges at the faces of the core form can be determined by a careful visual examination of these faces. If such examination shows there are no such folded-over edges, then the above-described abrading operation can be omitted.

By using the above-described abrading action, where needed, to remove external adhesions and by using the above-described telescoping action to remove internal adhesions, a core substantially free of both external and internal adhesions is produced. Such a core has substantially lower core loss than are present in a core manufactured by a corresponding process, but without these steps, as will be further discussed hereinafter.

As noted in the introductory portion of this application, amorphous metal cores that comprise strips wrapped about the core window are sometimes provided with adhesive coatings bonded to the lateral faces of the core form. An example of this type of core is disclosed and claimed in the aforesaid U.S. Pat. No. 4,734,975-Ballard et al.

The core illustrated in the present application is a core of this type, and one of our objects is to eliminate the above-described internal and external adhesions in such a core without interference from the adhesive coating material applied to the strip edges. To this end, we apply the adhesive material to the lateral faces of the core form after the annealing step and any wire-brushing step that is used but before the telescoping operation depicted in FIG. 3.

The adhesive material is applied to the lateral faces of the core form while in a viscous liquid state and is allowed to dry and partially harden, typically for a few hours, before the telescoping operation of FIG. 3 is carried out. Then after the telescoping operation, the strip edges are realigned, as above-described, after which the coating is heat cured, for example, by placing the core in a heated oven having an appropriately high temperature. This sequence of operations from annealing (67) to heat-curing (59) of the adhesive coating is illustrated in the flow diagram of FIG. 7.

While full curing of the coating may be accelerated by use of a heated curing oven, as above described, it is to be understood that the use of such an oven is not essential. The adhesive can be cured even in a room-temperature ambient if sufficient time is allowed. Any heat retained by the core from the annealing operation will facilitate full curing.

Figure 3A:
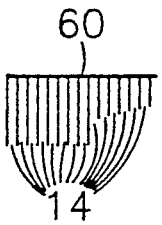
FIG. 3*a* is an enlarged sectional view of a portion of the core form illustrated in FIG. 3 taken adjacent the upper face of the core form.

FIG. 3*a* is an enlarged view of a portion of one face of the core form showing one of the above described adhesive coatings at 60. It is to be understood that such a coating is present on each of the faces of the core form shown in FIG. 3.

In our development work, consideration was given to applying the adhesive bonding material after the telescoping and edge-realigning operations. For reasons not yet fully understood, the bonding operation when performed at this point in the manufacturing sequence appeared to reintroduce a significant percentage of the core loss that had been eliminated by the telescoping and edge-realigning operations. Nevertheless, some reduction in core loss was still present despite such adhesive bonding (after telescoping and edge-realigning).

We have found that if the edge coatings are applied before the telescoping operation and the telescoping and edge-realigning operations are performed before the edge coatings have been fully cured, the core loss is significantly lower than if the edge coatings are first applied after the telescoping and edge-realigning operations have been completed.

One might question whether the edge coating is damaged by the telescoping operation since adjacent strips are laterally displaced with respect to each other by the telescoping operation. Our studies of this question indicate that such damage does not usually occur, partially because lateral displacement of each strip with respect to its juxtaposed strips is so extremely small. For example, in a typical core form rated 50kva, the build of the core (shown at B in FIG. 3) is about 3 inches and includes about 3000 strips, or turns, of the amorphous metal strip material, each of which typically has a thickness of only about 0.93 mils. A typical telescoping operation will laterally displace the inner turn of the core form about 1 inch from the outer turn. Assuming that each turn is laterally displaced by an equal amount as a result of the telescoping operation, the lateral displacement of each turn relative to its juxtaposed turns is only about 1/3000 inch, or about 0.00033 inch. This is such a tiny amount that the still soft coatings can sustain it without damage. Even if a small number of defects should be present or developed in the coatings, this is not of great significance because the coatings are relied upon primarily for mechanical reasons, for example, to impart stiffness and integrity to the core that facilitate subsequent lacing and handling.

While the amount of lateral displacement between juxtaposed strips is extremely small, as pointed out in the immediately-preceding paragraph, it is still great enough to disrupt any adhesions present between the juxtaposed strips. The effectiveness of this small amount of relative motion is believed to be attributable to the very brittle nature of the adhesions. Because of this extreme brittleness, the adhesions appear to be highly susceptible to disruption by the shearing stresses resulting from small amounts of this type of relative motion.

It should be recognized that there are upper limits upon the amount of telescoping that can be tolerated by the core form. If too great an amount of telescoping is allowed, it becomes very difficult to carry out the subsequent realigning operation without damaging the projecting lateral edge regions of the strips. Also the edge coating can be significantly damaged by large amounts of telescoping.

Figure 7:
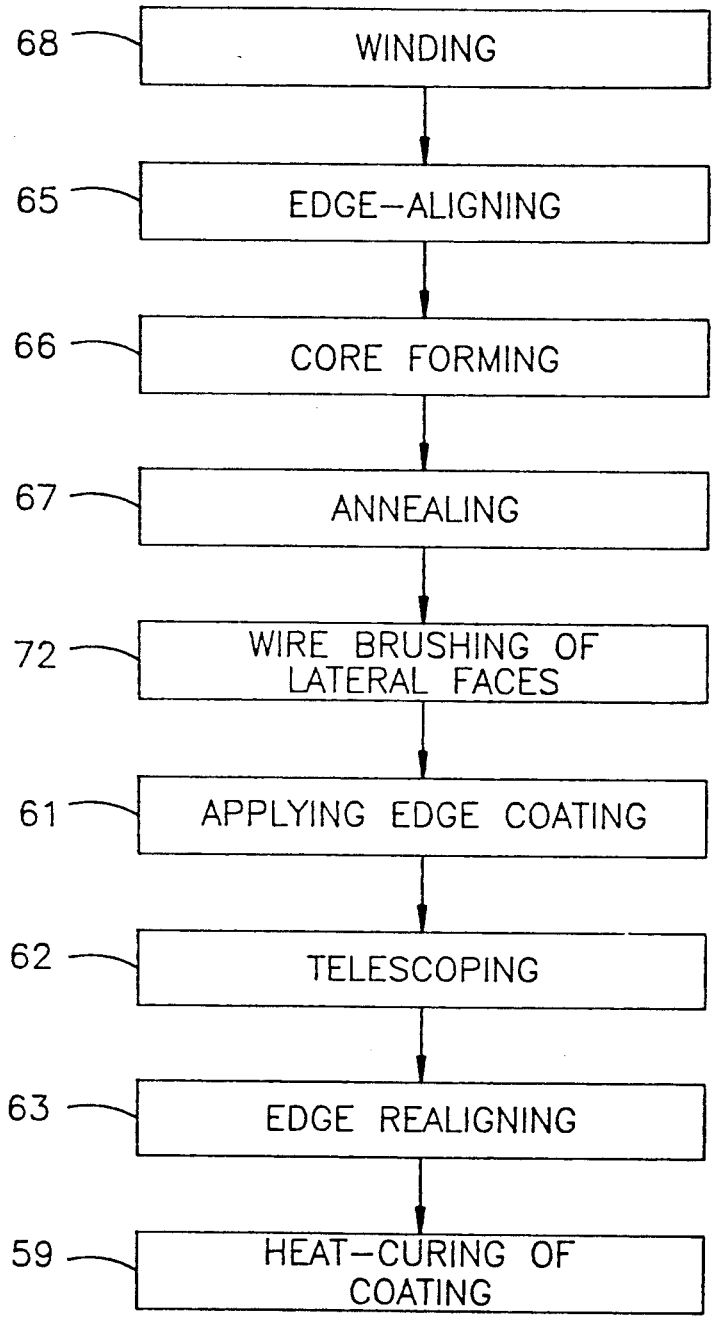
FIG. 7 is a flow diagram illustrating the various steps employed in making a core in accordance with one form of our invention.

The flow diagram of FIG. 7 diagrammatically illustrates the sequence of the above-described steps, the initial edge-coating step being designated 61, the telescoping step 62, and the edge-realigning step 63. One step not discussed above which is shown in the flow diagram is an edge-aligning step 65 between the core-winding step 68 and the core-forming step 67. Although an effort is made during the core-winding step 68 to keep the edges of the strip aligned at opposite faces of the core form, some small misalignments may still develop. To correct these misalignments, the core form is laid horizontally upon a planar surface to force the projecting edges at the adjacent face of the core form laterally back into alignment with the other edges at this face. To assist in this edge-aligning operation, a modest force may be applied to the upper face of the core form through a planar force-transmitting member. This edge pressing operation has been used in prior core-manufacturing operations to achieve better edge alignment and is therefore not shown in detail herein.

It is desirable for the core form to be in an edge-aligned condition when annealed since annealing establishes the normal position of each strip, and the subsequent edge-realigning operation 63 can be relied upon to return the strips to their normal positions.

Another advantage derived from the edge-aligning operation 65 is that its use often eliminates the need for the subsequent wire-brushing operation 72 of the lateral faces of the core form. As mentioned hereinabove, if the core form after emerging from the annealing operation still has all its strip edges closely aligned, then the wire-brushing, or abrading, operation is omitted. A careful visual inspection of the faces to determine whether there are projecting and/or folded-over edges will ordinarily be sufficient to determine whether wire brushing or any other type of abrading is needed.

The extent of the reduction in core loss resulting from the telescoping operation of FIG. 3 will vary depending upon the distribution, number, and size of the internal adhesions that are present in a given core form. Sometimes the telescoping operation will reduce the core loss by as much as 20 to 30 percent. On average, about a 10 percent reduction in core loss has been observed. Core loss was determined by placing a test winding about one leg of the core form and energizing the winding with appropriate voltage to send a predetermined exciting current through the winding. Core loss was measured in a conventional manner while this current was passing through the test winding. This procedure was conducted before and after the telescoping operation, and the measured core losses were thereafter compared.

Figure 8:
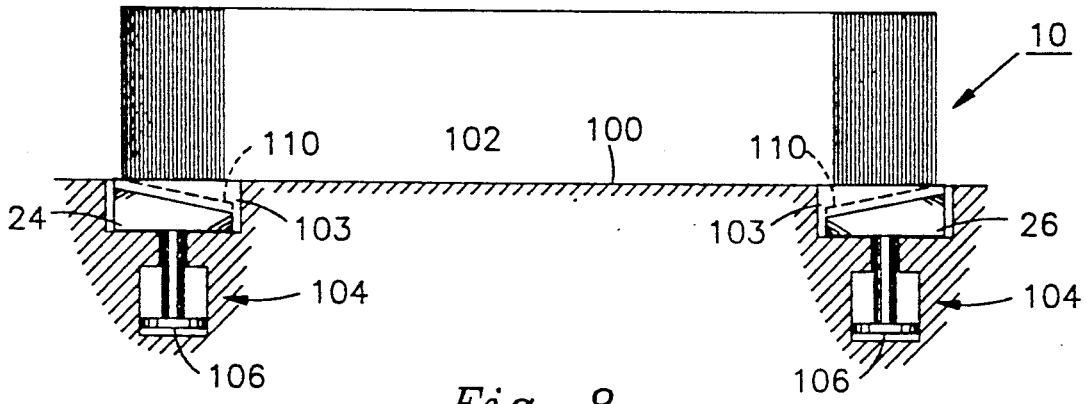
FIG. 8 is a sectional view similar to FIG. 3 except showing a method embodying a modified form of our invention.

While the procedure illustrated in FIG. 3 is a simple and effective way of telescoping the core form, our invention in its broader aspects is intended to comprehend variations thereof that accomplish substantially the same results. One such variation is illustrated in FIG. 8, which shows the core form 10 resting upon the horizontal planar surface 100 of a base 102. Base 102 contains a pair of slots 103 in which wedges 24 and 26 corresponding to the identically-designated wedges of FIG. 3 are slidably mounted for up and down motion. Upward motion of each wedge is produced by a fluid motor 104 comprising a piston 106 coupled to the associated wedge. When the piston 106 is driven upwardly, the upper surface of the associated wedge contacts the lower face of the core form, thus causing the core form to telescope into substantially the configuration shown in FIG. 3. It is to be noted that when the upwardly-moving wedges 24 and 26 first touch the lower face of the core form 10, as shown by the dotted lines 110 of FIG. 8, there is a gap of varying length between the lower face of the not-yet-telescoped core and the inclined upper surface of each wedge, just as in FIG. 3.

When the wedges 24 and 26 are lowered after this telescoping operation, the strips 14 of the core form return to their non-telescoping position of FIG. 8 under the influence of gravity.

Figure 9:
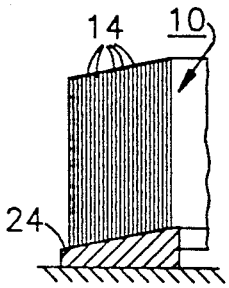
FIG. 9 is a fragmentary sectional view similar to FIG. 3 except showing a method embodying another modified form of our invention.

Another variation of the procedure of FIG. 3 is a procedure in which both of the wedges are reversed so that the upper surface of each wedge slopes downwardly from the inside to the outside of the core form. FIG. 9 illustrated this procedure and shows one of the wedges 24 oriented in this manner with respect to the core form 10. After the core form is telescoped in this manner, the upper surface of the core form 10 of FIG. 9 has the same configuration as the lower surface of the core form of FIG. 3. Removal of the wedges in FIG. 9 allows the lower face of the core to rest on the horizontal planar face of support plate 32, thus causing the strips 14 to return to their normal positions with respect to each other and restoring the core form to its normal, non-telescoping state.

Another variation of the core-telescoping procedure is one involving a combination of the procedure of FIG. 3 and the procedure of FIG. 9. More specifically, the core form is first telescoped using wedges (24, 26) oriented as in FIG. 3, following which it is restored to its normal, non-telescoping state. Then the core form is telescoped using wedges (24, 26) oriented as in FIG. 9, following which it is restored to its normal, non-telescoping state. This combination of operations has the effect of telescoping the core form in two opposite directions from its normal non-telescoping state. The result is a more complete disruption of adhesions throughout the core build.

This combination procedure can be carried out without employing a separate operation for restoring the core form to its normal, non-telescoping state following the first telescoping operation. More specifically, the second telescoping operation is carried out immediately following the first telescoping operation, and after the second telescoping operation the core form is restored to its normal, non-telescoping state. The second telescoping operation actually returns the core form to its normal, non-telescoping state but continues without pause to produce telescoping in the opposite direction.

Still other variations of the above-described telescoping operations can be employed for producing the desired disruption of the adhesions between juxtaposed strip sections. Several of these variations are shown in FIGS. 10, 11, 12 and 13 respectfully.

Figure 10:
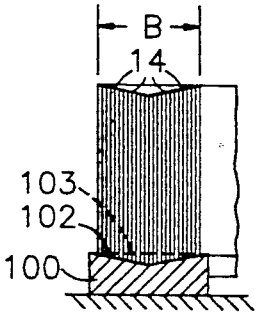
FIG. 10 is a sectional view of the core form of FIGS. 1 and 2 showing a telescoping operation used in a core-manufacturing method embodying another modified form of our invention.

In FIG. 10 the telescoping action is produced by a wedge member (100) that has a V-shaped upper surface 102 above which the normally planar lower face of the core form is positioned, as shown by dotted line 103. Proceeding from either periphery of the core form toward a location near the center of the build B, the strips !4 are telescoped downwardly with respect to the strips 14 at the peripheries. After such telescoping, the core form is placed on a planar horizontal surface, thereby returning the core form to its normal, non-telescoping state. Preferably, two wedge members 100 of identical shape are used at spaced locations on the core form to control the above-described telescoping action.

Figure 11:
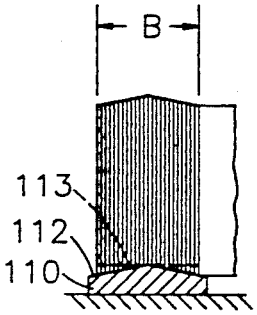
FIG. 11, 12, and 13, respectively, show additional modified forms of our invention.

In FIG. 11 the telescoping action is produced by a wedge member (110) that has an upper surface 112 of inverted V-form. The normally planar lower force of the core form (shown at 113) is positioned above surface 112, and the strips 14 then fall by gravity onto surface 112. Proceeding from either periphery of the core form toward a location near the center of the build B, the strips 14 are telescoped upwardly with respect to the strips 14 at the peripheries. After such telescoping, the core form is placed on a planar horizontal surface, thereby returning the core form to its normal, non-telescoping state. Preferably, two wedge members 110 of identical shape are used at spaced locations on the core form to control the above-described telescoping action.

Figure 12:
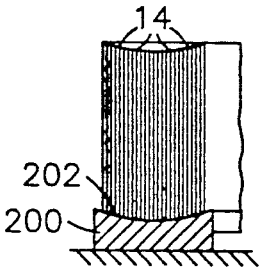

In the telescoping operation depicted in FIG. 12 a wedge member 200 similar to the wedge member 100 of FIG. 10 is used. Wedge member 200 differs from wedge member 100 primarily in having an upper surface (202) that consists of two curved portions forming a U-configuration rather than two planar portions forming a V-configuration, as in FIG. 10. The strips 14 are telescoped in the same manner in FIG. 12 as in FIG. 10 except that the amount of telescoping displacement varies across the face of the core form instead of being substantially constant, as in FIG. 12.

Figure 13:
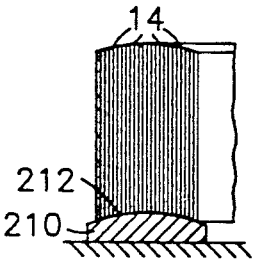

In the telescoping operation depicted in FIG. 13 a wedge member 210 similar to the wedge member 110 of FIG. 11 is used. Wedge member 210 differs from wedge member 110 primarily in having an upper surface (212) that consists of two curved portions forming an inverted U-configuration rather than two planar portions forming an inverted V-configuration, as in FIG. 11. The strips 14 are telescoped in the same manner in FIG. 13 as in FIG. 11 except that the amount of telescoping displacement varies across the face of the core form instead of being substantially constant, as in FIG. 11.

In each of the embodiments of FIGS. 12 and 13, preferably two wedge members of the identical shape shown are used at spaced locations on the core form to control the above-described telescoping action.

Still another variation of our method is to use the wedges of FIG. 10 for the initial telescoping action and the wedges of FIG. 11 for a second telescoping action, following which the core form is returned to its normal non-telescoping state by being placed on a flat horizontal surface. This method has the effect of telescoping the core in two opposite directions from its normal, non-telescoping state, thereby more completely disrupting adhesions throughout the core build.

It is to be understood that the order of these telescoping operations can be reversed and also that any one of the telescoping operations illustrated in FIGS. 3 and 8–13 can be combined with one of the others and carried out in succession to produce telescoping in opposite directions, followed by restoration of the core form to normal, non-telescoping state.

Figure 14:
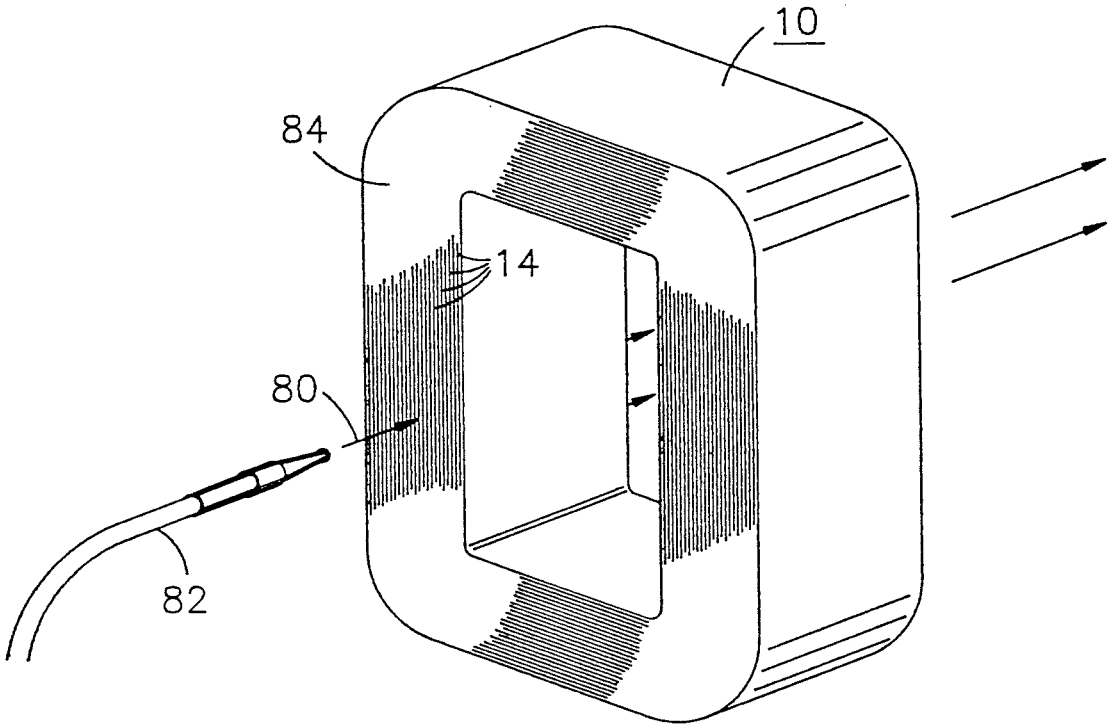
FIG. 14 is a perspective view illustrating a method embodying still another modified form of our invention.

Another procedure that can be used for disrupting the internal adhesions that are often present in the core form following annealing is the procedure illustrated in FIG. 14. In this procedure, the core form 10 is positioned vertically, and a blast 80 of compressed air is directed at its lateral face. An air hose 82 terminating in a suitably shaped nozzle is used for directing the compressed air at the core face 84. The nozzle outlet is placed closely adjacent the lateral face 84, and air is caused to flow laterally of the core between the amorphous strips or laminations 14, entering at one face and exiting at the other. The nozzle is moved about the entire lateral surface of the core form so that all regions of the core form are subjected to the air blast.

The air blast has the effect of slightly separating the juxtaposed strips or laminations, and this separation acts to break up adhesions that might be present. It is to be understood that the air blast is applied before application of the above-described edge coating, thus avoiding any interference by the edge coating with the air blast action.

A disadvantage of this procedure of FIG. 14 as compared to those of FIGS. 3 and 8-13 is that it is more expensive to practice than those of FIGS. 3 and 8-13, requiring more time, more labor, and compressed gas. Furthermore, the procedure of FIG. 14 requires that the entire edge bonding operation to be deferred until after the internal adhesions are disrupted. Still further, the procedure of FIG. 14 is considerably less effective than the procedures of FIGS. 3 and 8-13 in reducing core loss.

While FIG. 14 shows the core form positioned vertically during the air blast operation, it can alternatively be positioned horizontally. But if horizontally positioned, the core form must be kept spaced from most of its horizontal support so that compressed air is able to flow entirely across the width of the core form between its laminations. In the embodiment of FIG. 14, the core form can be hung from a horizontally-oriented post (not shown) extending through its window during the air blasting operation.

While we have specifically described our invention as applied to a cut-type of core (i.e., a core which has a joint, such as the joint present in the region 20 of FIG. 1), it is to be understood that the invention is also applicable to a core of the uncut type. These uncut cores are made by wrapping amorphous strip material without interruption about the core window to build up a core that has no such joint and is interlinked with one or more coils without cutting of the core. Such a core can be subjected to the telescoping action of any one of FIGS. 3 and 8-13 and to a subsequent edge realigning operation in order to disrupt any internal adhesions therein and can also be subjected to a wire brushing operation after annealing in order to remove any external adhesions from the lateral faces of the core. Such a core can also be subjected to the air blast operation of FIG. 14 to disrupt internal adhesions.

While we have shown and described particular embodiments of our invention, it will be obvious to those skilled in the art that various changes and modifications may be made without departing from the invention in its broader aspects; and we, therefore, intend herein to cover all such changes and modifications as fall within the true spirit and scope of the invention.

What we claim as new and desire to secure by Letters Patent of the United States is:

1. A method of manufacturing a core for an amorphous metal transformer comprising:

(a) providing a core form that includes a window and comprises sections of amorphous metal strip wrapped about said window, the strip sections having edges at laterally opposite sides thereof and the core form having at laterally-opposed sides of the core form a pair of faces where the edges of the strip sections are located, (b) annealing said core form to relieve stresses therein, (c) after said annealing step, displacing said strip sections laterally with respect to juxtaposed ones of said strip sections to develop a telescoping relationship between juxtaposed strip sections that disrupts short-circuiting adhesions between said juxtaposed strip sections that had developed during said annealing step, said displacing step moving the edges of said strip sections laterally from normal positions, and (d) thereafter returning said strip sections laterally to positions that restore their edges to substantially said normal positions.

2. A method as defined in claim 1 and further comprising: controlling said laterally displacement of said strip sections by providing at least one wedge member adjacent one face of said core form, the wedge member having an inclined surface that is positioned to limit lateral motion of said strip sections with respect to each other the inclined surface being so located that there is a gap of varying length between said inclined surface and said one face immediately prior to said displacement step.

3. A method as defined in claim 1 and further comprising:

controlling said lateral displacement of said strip sections by providing a plurality of spaced-apart wedge members adjacent one face of said core form, each wedge member having an inclined surface that is positioned to limit lateral motion of said strip sections with respect to each other, said inclined surface being so located that there is gap of varying length between said inclined surface and said one face immediately prior to said displacement step.

4. A method as defined in claim 1 and further comprising:

controlling said lateral displacement of said strip sections by positioning said core form so that the central axis of said window is generally vertical and one face of said core form is seated on at least one wedge member, said wedge member having an inclined surface onto which the edges of said strip sections at said one face of said core member fall when said core member is positioned on said wedge member with said window axis generally vertical, thereby effecting said lateral displacement of said strip sections.

5. A method as defined in claim 1 and further comprising:

controlling said lateral displacement of said strip sections by positioning said core from so that the central axis of said window is generally vertical and one face of said core form is seated on a plurality of spaced-apart wedge members, each wedge member having an inclined surface onto which the edges of said strip sections at said one face of said core member are displaced when said core member is positioned on said wedge members with said window axis generally vertical, thereby effecting said lateral displacement of said strip sections.

6. A method as defined in claim 1 and further comprising controlling said lateral displacement of said strip sections by forcing against one face of said core form a wedge member that has an inclined surface abutting the edges of said strip sections.

7. A method as defined in claim and further comprising controlling said lateral displacement of said strip sections by forcing against one face of said core form two spaced-apart wedge members, each having an inclined surface abutting the edges of said strip sections.

8. A method as defined in claim 1 and further comprising:

(a) after said annealing step, applying to one of said faces an adhesive coating that requires time for curing following application, and (b) causing said strip-section displacing step and said strip-section restoring step to be carried out after said coating has been applied to said one face but before full curing of said coating has occurred.

9. A method as defined in claim 1 and further comprising:

(a) after said annealing step, applying to said faces of the core form adhesive coatings that require time for curing following application, and (b) causing the strip-section displacing and restoring steps of (c) and (d), claim I, to be carried out after said coatings have been applied to said faces but before full curing of said coatings has occurred.

10. A method as defined in claim 1 and further comprising:

(a) abrading the faces of said core form to remove projecting edges of the amorphous strip sections therefrom, and (b) causing said abrading step to be carried out after said annealing step but before said strip-section displacing step.

11. A method as defined in claim 2 and further comprising:

(a) abrading the faces of said core form to remove projecting edges of the amorphous strip sections therefrom, and (b) causing said abrading step to be carried out after said annealing step but before said strip-section displacing step.

12. A method as defined in claim 8 and further comprising:

(a) after said annealing step, abrading the faces of said core form to remove projecting edges of the amorphous strip sections therefrom, and (b) causing said coating-applying step to be carried out with respect to said one face of said core form after said abrading step has been carried out with respect to said one face of said core form.

13. A method as defined in claim 9 and further comprising:

(a) after said annealing step, abrading the faces of said core form to remove projecting edges of the amorphous strip sections therefrom, and (b) causing said abrading step to be carried out before said adhesive coatings are applied.

14. A method as defined in claim 1 in which before said annealing step, said core form is subjected to an edge-aligning operation that forces the edges of said strip sections to be substantially aligned at each face of said core form.

15. A method as defined in claim 2 in which before said annealing step, said core form is subjected to an edge-aligning operation that forces the edges of said strip sections to be substantially aligned at each face of said core form.

16. The method of claim 1 in which said strip sections are discrete lengths of amorphous metal strip that extend about said core window and have ends meeting in a joint region of the core.

17. The method of claim 1 in which said core form is an uncut core form in which amorphous metal strip material extends uninterrupted for many turns about said window.

18. A method as defined in claim 1 and further comprising: after said annealing step, abrading the faces of said core form to remove projecting edges of the amorphous metal strip sections from said faces thereby disrupting externally-located adhesions formed by said projecting edges between juxtaposed strip sections.

19. A method as defined in claim 2 and further comprising: after said annealing step, abrading the faces of said core form to remove projecting edges of the amorphous metal strip sections from said faces thereby disrupting externally-located adhesions formed by said projecting edges between juxtaposed strip sections.

20. A method of manufacturing a core for an amorphous metal transformer comprising:

(a) providing a core form that includes a window and comprises sections of amorphous metal strip wrapped about said window, the strip sections having edges at laterally opposite sides thereof and the core form having at laterally-opposed sides of the core form a pair of faces where the edges of the strip sections are located, (b) annealing said core form to relieve stresses therein, (c) after said annealing step, disrupting short-circuiting internal adhesions between juxtaposed strip sections that had developed during said annealing step by a procedure that subjects said adhesions to disruptive force of such a character that it causes relative movement between juxtaposed strip sections without cracking or shattering the strip sections, (d) abrading the faces of said core form to remove projecting edges of the amorphous strip sections therefrom, and (e causing said abrading step to be carried out after said annealing step but before said adhesion-disrupting step of (c), hereinabove.

21. A method of manufacturing a core for an amorphous metal transformer comprising:

(a) providing a core form that includes a window and comprises sections of amorphous metal strip wrapped about said window, the strip sections having edges at laterally opposite sides thereof and the core form having at laterally-opposed sides of the core form a pair of faces where the edges of the strip sections are located, (b) annealing said core form to relieve stresses therein, (c) after said annealing step, temporarily forcing juxtaposed strip sections apart by applying to one of said faces a blast of gas that flows from said one face to the other face by paths extending between juxtaposed strip sections and acts to disrupt short-circuiting adhesions in the zone of said core form traversed by said air blast, and (d) moving said blast of gas over the exposed surface of said one face so as to subject the adhesions in additional core zones to the disrupting action of said air blast.

22. A method as defined in claim 21 and further comprising:

(a) abrading the faces of said core form to remove projecting edges of the amorphous strip sections therefrom, and (b) causing said abrading step to be carried out after said annealing step but before said adhesion-disrupting step of (c), claim 20.

23. A method as defined in claim I in which:

(a) step (c) of claim displaces said strip sections laterally with respect to juxtaposed ones of said strip sections in a first lateral direction from said normal positions, and (b) said core form is subjected to a second telescoping action following step (c) of claim that displaces said strip sections laterally in a second lateral direction from said normal positions that is opposite to said first lateral direction.

24. A method as defined in claim 23 and further comprising:

(a) controlling said lateral displacement of said strip sections in said first lateral direction by providing at least one wedge member adjacent one face of said core form, the wedge member having an inclined surface that is positioned to limit lateral motion of said strip sections with respect to each other in said first lateral direction, and (b) controlling said lateral displacement of said strip sections in said second lateral direction by providing at least one wedge member adjacent the opposite face of said core form, said latter wedge member having an inclined surface that is positioned to limit lateral motion of said strip sections with respect to each other in said second lateral direction.

25. The method of claim 2 in which the inclined face of said one wedge member extends across the entire build of said core form in such a manner that said gap is of increasing length, proceeding from one periphery to the other of said core form.

26. The method of claim 2 in which the inclined face of a said one wedge member has a V or U shaped configuration.

* * * * *

UNITED STATES PATENT AND TRADEMARK OFFICE

CERTIFICATE OF CORRECTION

PATENT NO. : 5,134,771

DATED : August 4, 1992

INVENTOR(S) : Albert C. Lee, et. al.

It is certified that error appears in the above-indentified patent and that said Letters Patent is hereby corrected as shown below:

On the Title page, item [54], col. 1, line 1, in the Title "and " should read--an--.

Column 12, line 13, after "other". a comma (,) should be inserted--.

Column 12, line 62, after "claim", insert--1--.

Column 14, line 65, "20" should be changed to --21--.

Column 15, line 4, after "claim" , the following should be inserted --1--.

Signed and Sealed this

Seventh Day of September, 1993

Bruce Lehman

*Attest:*

BRUCE LEHMAN

*Attesting Officer*

*Commissioner of Patents and Trademarks*